United States Patent [19]

Baltz et al.

[11] Patent Number: 5,034,163

[45] Date of Patent: Jul. 23, 1991

[54] MODULAR SIDE-DRAFT CARBURETOR

[75] Inventors: Gene F. Baltz, Lake Villa; Simon Levin, Deerfield, both of Ill.; LeRoy T. Wood, Racine, Wis.

[73] Assignee: Outboard Marine Corporation, Waukegan, Ill.

[21] Appl. No.: 132,630

[22] Filed: Dec. 4, 1987

Related U.S. Application Data

[63] Continuation of Ser. No. 886,633, Jul. 16, 1986, abandoned.

[51] Int. Cl.[5] ..... F02M 3/12

[52] U.S. Cl. ..... 261/34.1; 261/41.5; 261/DIG. 38

[58] Field of Search ..... 261/41.5, 34.1, DIG. 38

[56] References Cited

U.S. PATENT DOCUMENTS

| | | | |
|---|---|---|---|
| 1,568,881 | 1/1926 | Constantinesco . | |
| 2,656,166 | 10/1953 | Foster | 261/41.5 |
| 2,892,622 | 6/1959 | Goodyear | 261/41 |
| 2,906,251 | 9/1959 | Soder, Jr. . | |
| 3,105,861 | 10/1963 | Korte | 261/41.5 |
| 3,168,599 | 2/1965 | Marsee et al. | 261/DIG. 39 |
| 3,177,920 | 4/1965 | Phillips | 261/DIG. 68 |
| 3,231,249 | 1/1966 | Kalert, Jr. | 261/41.5 |
| 3,247,548 | 4/1966 | Fields et al. | 264/318 |
| 3,275,305 | 9/1966 | Nutten | 261/34 |
| 3,281,129 | 10/1966 | Payne | 261/34 |
| 3,283,050 | 11/1966 | Boggs | 264/318 |
| 3,307,836 | 3/1967 | Arndt et al. | 261/34 |
| 3,345,045 | 10/1967 | Tuggle | 261/34 |
| 3,409,277 | 11/1968 | Reise | 261/34.1 |
| 3,948,589 | 4/1976 | DuBois . | |
| 3,985,837 | 10/1976 | Rock | 261/41 |
| 4,000,224 | 12/1976 | Phelps | 261/36 A |
| 4,003,968 | 1/1977 | Rickert | 261/35 |
| 4,046,844 | 9/1977 | Rickert | 261/DIG. 39 |
| 4,205,024 | 5/1980 | Hirosawa | 261/34 R |
| 4,414,163 | 11/1983 | Barr et al. | 261/DIG. 8 |
| 4,496,497 | 1/1985 | Satoh | 261/41 D |

*Primary Examiner*—Tim Miles

*Attorney, Agent, or Firm*—Michael, Best & Friedrich

[57] ABSTRACT

A carburetor comprising a combined float bowl and venturi section including an air passage with a venturi, a rotatably supported throttle valve plate located in the air passage, and a float chamber adapted to contain fuel, and a separate metering section mounted on the float bowl and venturi section, the metering section being molded of plastic and including a fuel passage communicating between the float chamber and the air passage, a needle valve seat within the fuel passage, an internally threaded bore having therein threads molded integrally with the metering section, and an externally threaded needle valve threadedly received in the bore and being movable into and out of engagement with the valve seat for controlling fuel flow through the fuel passage.

22 Claims, 2 Drawing Sheets

MODULAR SIDE-DRAFT CARBURETOR

BACKGROUND OF THE INVENTION

The invention relates to carburetors, and, more particularly, to modular side-draft carburetors for small displacement internal combustion engines.

Conventional carburetors include an internally threaded bore threadedly receiving an externally threaded needle valve. The threads in the bore are typically formed by tapping. This requires an extra manufacturing step and also necessitates cleaning of the bore to remove cuttings.

Conventional carburetors also include a nozzle well formed by an integral portion of the venturi section or of the float bowl section. The volume of the nczzle well cannot be changed without replacing the entire section which includes the nozzle well.

It is known to provide carburetors with circuitous fuel passages. Such passages are typically formed by a series of angled passages drilled or cored in the carburetor body.

SUMMARY OF THE INVENTION

The invention provides a carburetor comprising a float bowl and venturi assembly including an air passage and a float chamber adapted to contain fuel, and a separate metering section mounted on the float bowl and venturi assembly, the metering section being molded of plastic and including a fuel passage communicating between the float chamber and the air passage, a needle valve seat within the fuel passage, an internally threaded bore having therein threads molded integrally with the metering section, and an externally threaded needle valve threadedly received in the bore and being movable into and out of engagement with the valve seat for controlling fuel flow through the fuel passage.

The invention also provides a carburetor comprising a float bowl and venturi assembly including an air passage and a float chamber adapted to contain fuel, and flexible passage means communicating between the float chamber and the air passage for conducting fuel therebetween.

In one embodiment, the carburetor further comprises a nozzle well communicating with the float chamber, and the flexible passage means communicates with the nozzle well.

In one embodiment, the air passage forms a venturi, and the carburetor further comprises a nozzle having a first end communicating with the nozzle well and a second end communicating with the venturi.

The invention also provides a carburetor comprising a float bowl and venturi assembly including an air passage with a venturi and a float chamber adapted to contain fuel, a separate nozzle well section defining a nozzle well communicating with the float chamber, and a nozzle having a first end communicating with the nozzle well and a second end communicating with the venturi.

In one embodiment, the float bowl and venturi assembly includes a seParate venturi section including the air passage, and a separate float bowl section at least partially defining the float chamber, and the nozzle well section is trapped between the venturi section and the float bowl section.

In one embodiment, the carburetor further comprises means for locating the nozzle well section relative to the float bowl section.

In one embodiment, the locating means includes a locating rib extending from the float bowl section, and the nozzle well section engages the locating rib such that lateral movement of the nozzle well section relative to the float bowl section is substantially prevented.

In one embodiment, the carburetor further comprises means for locating the nozzle well section relative to the venturi section.

In one embodiment, the locating means includes, in the venturi section, a portion having an inner wall defining a recess, and, on the nozzle well section, a projection received in the recess.

A principal feature of the invention is the provision of a separate metering section molded of plastic and including an internally threaded bore which receives an externally threaded needle valve and which has threads molded integrally with the metering section. This eliminates the step of tapping the threads.

Another principal feature of the invention is the provision of flexible passage means communicating between the float chamber and the air passage. This permits the fuel passage between the float chamber and the air passage to follow a circuitous route without requiring the formation of angled passages in the body of the carburetor.

Another principal feature of the invention is the provision of a separate nozzle well section. This permits changing the volume of the nozzle well without replacing other components of the carburetor such as the venturi section or float bowl section.

Other principal features of the invention will become apparent to those skilled in the art upon review of the following detailed description, claims, and drawings.

Figure 1:
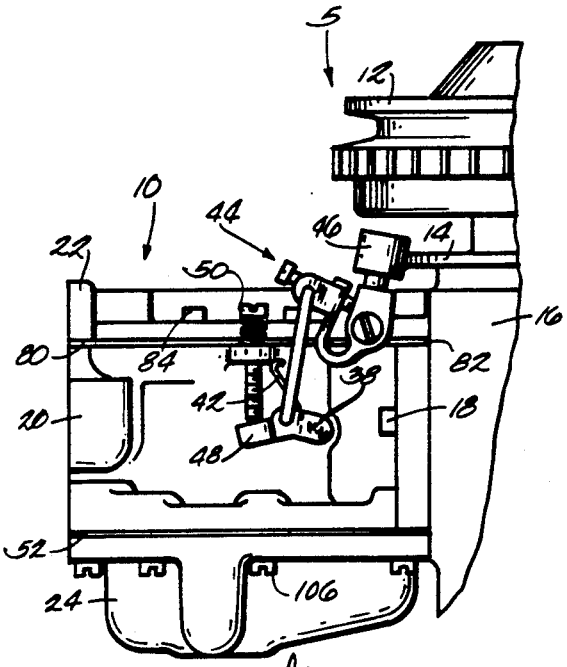
FIG. 1 is a partial, side elevational view of an internal combustion engine including a carburetor embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An internal combustion engine 5 including a carburetor 10 embodying the invention is illustrated in the drawings. As shown in FIG. 1, the engine 5 includes a flywheel 12, a timing cam 14, and an intake manifold 16. The carburetor 10 is mounted on the intake manifold 16 by suitable means such as bolts 18.

Figure 2:
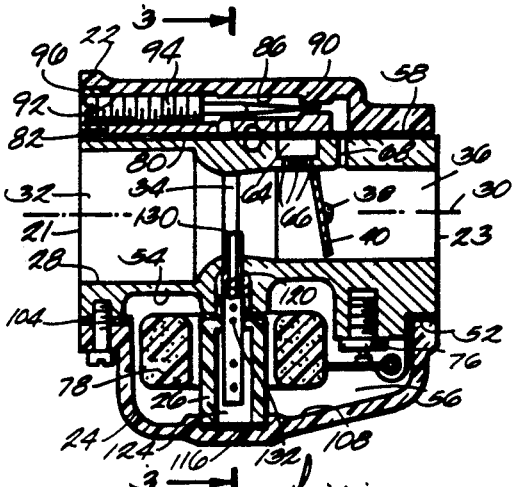
FIG. 2 is a vertical cross-sectional view of the carburetor.

The carburetor 10 is modular and has four primary sections: a venturi section 20; a metering section 22; a float bowl section 24; and a nozzle well section 26 (see FIG. 2). These sections provide a high-speed fuel metering circuit and a low-speed fuel metering circuit.

The venturi section 20 is preferably made of aluminum, includes opposite end surfaces 21 and 23, and has extending therethrough (see FIG. 2) an air passage 28 having an axis 30 and an upstream end forming an air inlet 32 in the end surface 21, a middle portion forming a venturi 34, and a downstream end forming a throttle bore 36 in the end surface 23. The venturi section 20 includes a rotatably supported throttle shaft 38, and a throttle valve plate or member 40 mounted on the throttle shaft 38 located within the throttle bore 36 and extending through aligned bores extending to the exterior surfaces of the venturi section 20. A spring 42 (FIGS. 1 and 3) biases the throttle shaft 38 to the position in which the throttle valve plate 40 closes the throttle bore 36.

Means are provided for rotating the throttle shaft 38 so that the throttle valve plate 40 opens the throttle bore 36. While various suitable rotating means can be employed, in the preferred embodiment, such means includes (see FIG. 1) a linkage 44 which rotates the throttle shaft 38 in response to movement of the timing cam 14. The linkage 44 includes a roller 46 which engages the timing cam 14 and which is operably connected to a lever arm 48 fixedly mounted on the end of the throttle shaft 38. Such a linkage is disclosed in U.S. Pat. No. 2,906,251 to Soder, which is incorporated herein by reference.

Means are also provided for limiting movement of the throttle shaft 38 under the influence of the spring 42, i.e., for preventing movement of the throttle valve plate 40 to a position completely closing the throttle bore 36. While various suitable limiting means can be employed, in the illustrated construction, such means includes a cracking screw 50 mounted on the venturi section 20 and having an end engagable with the lever arm 48 for limiting movement thereof.

Figure 4:
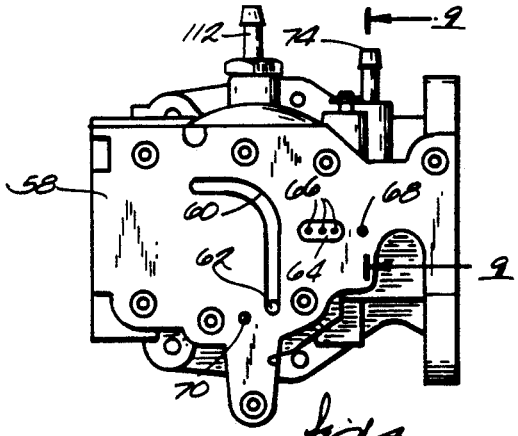
FIG. 4 is a top view of the venturi section of the carburetor.

The venturi section 20 has a generally planar lower exterior surface 52 which is generally parallel to the axis 30 of the air passage 28 and which has therein a recess 54 (FIG. 2) defining the upper portion of a float chamber 56. The venturi section 0 also has a generally planar upper exterior surface 58 which extends generally parallel to the lower surface 52. Extending between the opposite end surfaces 21 and 23 and between the upper and lower exterior surfaces 52 and 58, respectively, and on opposite sides of the air induction passage 28, are third and fourth exterior surfaces or faces 55 and 59. The upper surface 58 has therein (see FIG. 4) a L-shaped recess or channel 60 having one end communicating with the float chamber 56 via a vent passage or bore 62. The upper surface 58 also has therein a recess forming a low-speed or off-idle calibration metering passage or bore 64 which communicates with the throttle bore 36 via a plurality of fuel control/air bleed control metering apertures 66. As shown in FIG. 2, the low-speed metering apertures or bores 66 are preferably located downstream of the venturi 34 and upstream of the throttle valve plate 40.

The venturi section 20 also includes an idle fuel discharge passage 68 communicating between the throttle bore 36 and the upper surface 58. As shown in FIG. 2, the idle fuel discharge passage 68 is preferably located downstream of the throttle valve Plate 40. The venturi section 20 also includes (see FIGS. 3, 4, 6 and 7) a low-speed delivery tube 70 having an upper end positioned flush with the upper surface 58 and a lower end located in the float chamber 56.

Figure 9:
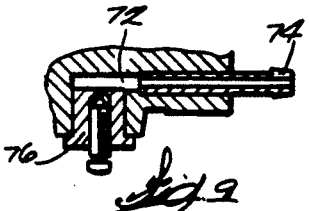
FIG. 9 is a cross-sectional view taken along line 9—9 in FIG. 4.

The venturi section 20 further includes (see FIG. 9) a fuel inlet passage 72 located in a bore and having an outer end communicating with a nipple 74 adapted to be connected to a source of fuel, and an inner end communicating with a conventional float inlet valve 76. As is apparent from viewing FIG. 2, opening and closing of the inlet valve 76 is controlled by a conventional float 78 pivotally mounted on the venturi section 20 and located within the float chamber 56. When the float 78 is buoyed upwardly, as shown in FIG. 2, the inlet valve 76 is closed and fuel is prevented from flowing into the float chamber 56. As the fuel level in the float chamber 56 drops, the float 78 moves downwardly and opens the inlet valve 76, thereby permitting fuel to flow into the float chamber 56.

Figure 5:
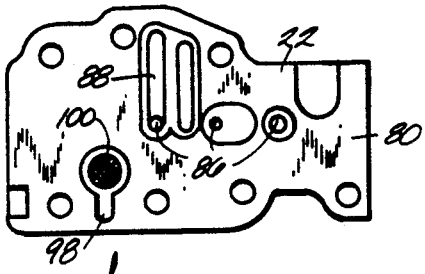
FIG. 5 is a bottom view of the metering section of the carburetor.
Figure 6:
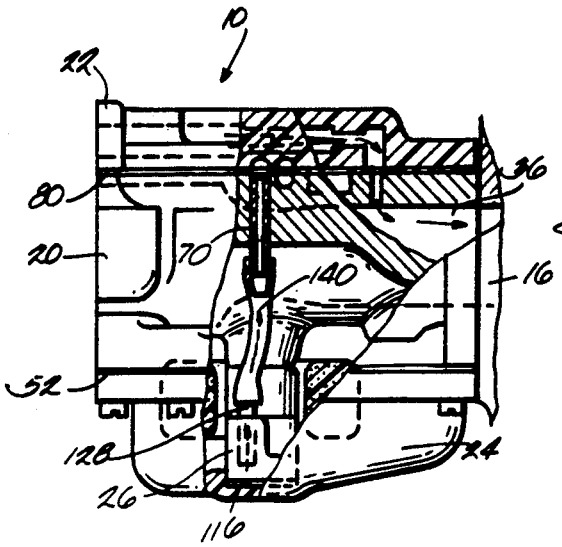
FIG. 6 is a side view, partially cut away, of the carburetor.

The metering section 22 is preferably molded of plastic and has a generally planar lower surface 80 shown in FIG. 5. As shown in FIG. 1, the metering section 22 is mounted on the venturi section 20 with the lower surface 80 of the metering section 22 separated from the upper surface 58 of the venturi section 20 by a gasket 82. The metering section 22 is secured to the venturi section 20 by suitable means such as bolts 84. The gasket 82 has therein a plurality of apertures for permitting the bolts 84 to extend therethrough and for permitting fluid communication between the various passages in the venturi section 20 and the various passages in the metering section 22.

The metering section 22 includes (see FIG. 2) a fuel passage 86 having a downstream end communicating with the fuel idle discharge passage 68, and an upstream end communicating, via a channel or groove 88 (see FIGS. 3 and 5) in the lower surface 80 of the metering section 22, with the upper end of the low-speed delivery tube 70. Intermediate its upstream and downstream ends, the fuel passage 86 communicates with the off-idle calibration metering passage 64, as shown in FIG. 2.

As also shown in FIG. 2, the metering section 22 includes a needle valve seat 90 located within the fuel passage 86 between the metering passage 64 and the downstream end of the fuel passage 86. The metering section 22 also includes an internally threaded bore 92 which, in the preferred embodiment, extends axially from the downstream end (the left end in FIG. 2) of the fuel passage 86, and an externally threaded needle valve 94 which is threadedly received in the bore 92 and which is movable into and out of engagement with the valve seat 90 for controlling fuel flow through the fuel passage 86 to the discharge passage 68. In the preferred embodiment, the threads of the bore 92 are molded integrally with the metering section 22 rather than being tapped, as is common in the prior art. Because the valve seat 90 is located downstream of the off-idle calibration metering passage 64, the needle valve 94 does not affect fuel flow thereto. A seal 96 prevents fuel leakage through the internally threaded bore 92.

The metering section 22 also includes (see FIG. 5) a passage 98 which communicates between the atmosphere and the end of the channel 60 opposite the float chamber vent passage 62 for venting the float chamber 56 to the atmosphere. The passage 98 has therein a filter 100.

Figure 8:
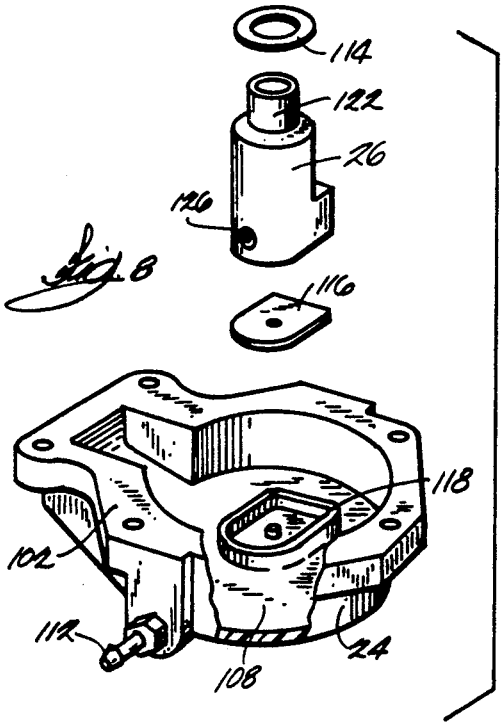
FIG. 8 is a partial exploded view of the carburetor.

As shown in FIG. 8, the float bowl section 24 is preferably made of plastic and is generally cup-shaped with an upper rim forming a generally planar upper surface 102. As shown in FIGS. 1 and 2, the float bowl section 24 is mounted on the venturi section 20 with a gasket 104 separating the upper surface 102 of the float bowl section 24 and the lower surface 52 of the venturi section 20. The float bowl section 24 is connected to the venturi section 20 by suitable means such as bolts 106. The combined venturi section 20 and float bowl section 24 form a float bowl and venturi assembly.

The float bowl section 24 includes (see FIGS. 2 and 8) a lower wall 108 having an upper surface defining the bottom of the float chamber 56, and the float bowl section 24 and the recess 54 of the venturi section 20 combine to form the float chamber 56. The float bowl section 24 also includes (see FIG. 3) a passage 110 having an inner end communicating with the float chamber 56 and an outer end communicating with a nipple 112. The nipple 112 is adapted to be connected to a manual priming system such as the one disclosed in U.S. Pat. No. 3,948,589 to DuBois, which is incorporated herein by reference.

Figure 7:
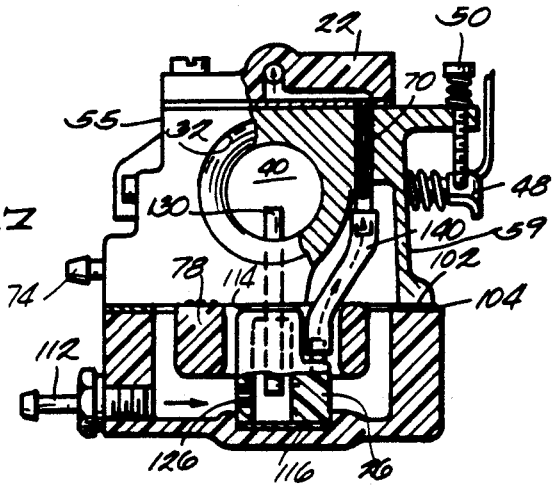
FIG. 7 is an end view (from the left end in FIG. 1), partially cut away, of the carburetor.

In the preferred embodiment, the nozzle well section 26 is made of plastic and is trapped between the float bowl section 24 and the venturi section 20. As shown in FIGS. 7 and 8, a gasket 114 seals the joint between the upper end of the nozzle well section 26 and the venturi section 20, and a gasket 116 seals the joint between the lower end of the nozzle well section 26 and the float bowl section 24.

Means are provided for locating the nozzle well section 26 relative to the float bowl section 24. While various suitable locating means can be employed, in the preferred embodiment, such means includes (see FIG. 8) an endless locating rib 118 extending upwardly from the lower wall 108 of the float bowl section 24. The lower end of the nozzle well section 26 engages or fits within the locating rib 118 such that lateral moveme nozzle well section 26 relative to the float bowl section 24 is substantially prevented.

Means are also provided for locating the nozzle well section 26 relative to the venturi section 20. While various suitable locating means; can be employed, in the illustrated construction, such means includes, in the venturi section 20, a downwardly extending portion having an inner wall defining a cylindrical recess 120 (FIG. 2), and, on the upper end of the nozzle well section 26, an upwardly extending annular flange or projection or sleeve 122 (FIG. 8) received in the recess 120. Engagement of the flange 122 with the inner wall of the recess 120 substantially prevents lateral movement of the nozzle well section 26 relative to the venturi section 20.

The nozzle well section 26 defines a nozzle well 124 and includes (see FIGS. 3 and 7) a high-speed metering orifice 126 communicating between the float chamber 56 and the nozzle well 124. The nozzle well section 26 has mounted therein (see FIG. 3) a low speed metering duct or tube 128 which constitutes a metering orifice. The tube 128 has a lower end communicating with the nozzle well 124 and an upper end located in the float chamber 56. The upper end of the tube 128 is adapted, as will be explained, to be connected to the delivery tube 70.

Figure 3:
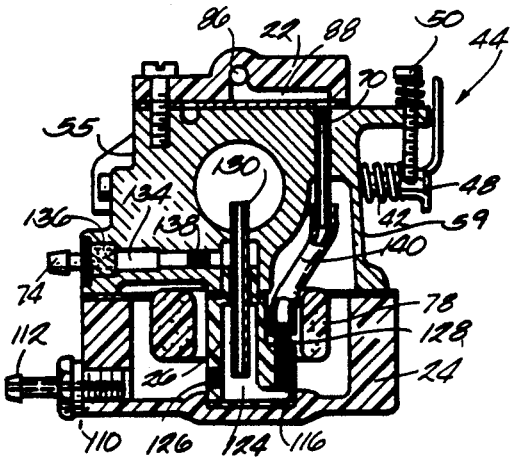
FIG. 3 is a cross-sectional view taken along line 3—3 in FIG. 2.

The carburetor 10 further comprises a high-speed nozzle 130 having a lower end communicating with the nozzle well 124 and an upper end communicating with the venturi 34. The nozzle 130 has therein (see FIG. 2) a plurality of air bleed holes 132. Preferably, the nozzle 130 extends through a bore in the venturi section 20, through the sleeve 122, and through the cylindrical recess 120. The nozzle well 124 and the recess 120 communicate with the atmosphere via an air passage or bore 134. As shown in FIG. 3, the passage 134 has therein an air bleed filter 136, and an air bleed control orifice 138.

The carburetor 10 further comprises (see FIGS. 3, 6 and 7) flexible passage means communicating between the upper end of the low-speed metering tube 128 and the lower end of the low-speed delivery tube 70. While various suitable flexible passage means can be used, in the illustrated construction, such means includes a flexible, non-metallic plastic tube 140.

The high-speed metering circuit includes the high-speed metering orifice 126, the nozzle well 124, the nozzle 130, the nozzle air bleed holes 132, and the air passage 134 (including the air bleed control orifice 138 and the air bleed filter 136).

The low-speed (i.e. idle speed and low speeds above idle) metering circuit includes the nozzle well 124, the low-speed metering tube 128, the flexible tube 140, the low-speed delivery tube 70, the channel 88, the fuel passage 86, the low-speed calibration metering passage 64, the metering apertures 66, and the idle fuel discharge passage 68. At engine idle speed, fuel flows from the nozzle well 124 to the fuel passage 86 via the low-speed metering tube 128, the flexible tube 140, the low-speed delivery tube 70, and the channel 88. Air passing through the low-speed calibration metering passage 64 is mixed with the fuel in the fuel passage 86 to form an emulsion. The fuel/air emulsion flow rate is controlled by the needle valve 94 so that a correct amount of fuel-/air emulsion is discharged through the idle discharge passage 68 into the throttle bore 36. At low engine speeds above idle, additional fuel is drawn into the throttle bore 36 via the metering holes 66.

Various features of the invention are set forth in the following claims.

We claim:

1. A carburetor comprising a float bowl and venturi assembly including an air passage and a float chamber adapted to contain fuel, a separate metering section mounted on said float bowl and venturi assembly, said metering section including a fuel passage communicating with said air passage, and flexible passage means communicating between said float chamber and said fuel passage.

2. A carburetor as set forth in claim 1 wherein said fuel passage includes a needle valve seat, an internally threaded bore, and an externally threaded needle valve threadedly received in said bore and being movable into and out of engagement with said valve seat for controlling fuel flow through said fuel passage.

3. A carburetor as set forth in claim 1 and further comprising a nozzle well communicating with said float chamber, and wherein said flexible passage means communicates with said nozzle well.

4. A carburetor as set forth in claim 1 wherein said air passage forms a venturi, and wherein said carburetor further comprises a separate nozzle well section defining a nozzle well communicating with said float chamber, and a nozzle having a first end communicating with said nozzle well and a second end communicating with said venturi.

5. A carburetor comprising a float bowl and venturi assembly including an air passage forming a venturi and a float chamber adapted to contain fuel, a separate metering section mounted on said float bowl and venturi assembly, said metering section being molded of plastic and including a fuel passage communicating with said air passage, an internally threaded bore communicating wtih said fuel passage, having therein threads molded integrally with said metering section, and adapted to receive an externally threaded needle valve, and flexible passage means communicating between said float chamber and said fuel passage.

6. A carburetor as set forth in claim 5 wherein said flexible passage means communicates with said nozzle well.

7. A carburetor comprising a float bowl and venturi assembly including an air passage and a float chamber adapted to contain fuel, and non-metallic flexible passage means extending exteriorly of said air passage and communicating between said float chamber and said air passage for supplying fuel from said float chamber to said air passage.

8. A carburetor as set forth in claim 7 and further comprising a nozzle well located in and communicating with said float chamber, and wherein said flexible passage means communicates with said nozzle well.

9. A carburetor as set forth in claim 8 wherein said air passage forms a venturi, and wherein said carburetor further comprises a nozzle having a first end communicating with said nozzle well and a second end communicating with said venturi.

10. A carburetor as set forth in claim 9 and further comprising a separate nozzle well section defining said nozzle well.

11. A carburetor comprising a venturi section including an air passage with a venturi, a float bowl section including a float chamber adapted to contain fuel, means releasably connecting said venturi section and said float bowl section, a separate nozzle well section defining a nozzle well communicating with said bloat chamber, and means on said float bowl section and on said nozzle well section for trapping said nozzle well section between said venturi section and said float bowl section incident to connection thereof and for locating said nozzle well section relative to said float bowl section.

12. A carburetor as set forth in claim 11 wherein said locating means includes a locating rib extending from said float bowl section, and wherein said nozzle well section engages said locating rib such that lateral movement of said nozzle well section relative to said float bowl section is substantially prevented.

13. A carburetor as set forth in claim 11 and further comprising means for locating said nozzle well section relative to said venturi section.

14. A carburetor as set forth in claim 13 wherein said locating means includes, in said venturi section, a portion having an inner wall defining a recess, and, on said nozzle well section, a projection received in said recess.

15. A carburetor comprising a venturi section including an air passage having upstream and downstream ends and forming a venturi, and a throttle valve member located in said air passage, a separate float bowl section including a float chamber adapted to contain fuel, a separate metering section mounted on said venturi section and molded of plastic, said metering section including a fuel passage having upstream and downstream ends and a needle valve seat intermediate said ends, said downstream end of said fuel passage communicating with said air passage at a point downstream of said throttle valve member, an internally threaded bore having therein threads molded integrally with said metering section, and an externally threaded needle valve threadedly received in said bore and being movable into and out of engagement with said valve seat for controlling fuel flow through said fuel passage, a separate nozzle well section defining a nozzle well communicating with said float chamber, said nozzle well section being trapped between said venturi section and said float bowl section, a nozzle having a first end communicating with said nozzle well and a second end communicating with said venturi, and flexible passage means communicating between said nozzle well and said upstream end of said fuel passage.

16. A carburetor as set forth in claim 15 and further comprising means for locating said nozzle well section relative to said float bowl section.

17. A carburetor as set forth in claim 16 wherein said locating means includes a locating rib extending from said float bowl section, and wherein said nozzle well section engages said locating rib such that lateral movement of said nozzle well section relative to said float bowl section is substantially prevented.

18. A carburetor as set forth in claim 15 and further comprising means for locating said nozzle well section relative to said venturi section.

19. A carburetor as set forth in claim 18 wherein said locating means includes, in said venturi section, a portion having an inner wall defining a recess, and, on said nozzle well section, a projection received in said recess.

20. A carburetor comprising a venturi section including an air passage having a venturi, a separate float bowl section including a float chamber adpated to contain fuel, means releasably connecting said venturi section and said float bowl section, a separate nozzle well section trapped between said venturi section and said float bowl section incident to connection of said venturi section and said float bowl section and defining a nozzle well communicating with said float chamber, and a separate nozzle having a first end communicating with said nozzle well and a second end communicating with said venturi.

21. A carburetor comprising a venturi section including an air passage having a venturi, and a throttle valve member located in said air passage, a float bowl section mounted on said venturi section and including a float chamber adapted to contain fuel, a metering section mounted on said venturi section and including a fuel passage communicating with said air passage at a point downstream of said throttle valve member, a nozzle well section trapped between said venturi section and said float bowl section and defining a nozzle well communicating with said float chamber, a nozzle having a first end communicating with said nozzle well and a second end communicating with said venturi, and flexible passage means located exteriorly of said nozzle and communicating between said nozzle well and said fuel passage.

22. A carburetor comprising a venturi section including an air passage having a venturi, a float bowl section mounted on asid venturi section and including a float chamber adapted to contain fuel, a metering section mounted on said venturi section and including a fuel passage communicating with said air passage, a nozzle well section trapped between said venturi section and said float bowl section and defining a nozzle well communicating with said float chamber, a nozzle having a first end communicating with said nozzle well and a second end communicating with said venturi, and flexible passage means communicating between said nozzle well and said fuel passage.

* * * * *